US009225094B2

(12) United States Patent
Kroeckel

(10) Patent No.: US 9,225,094 B2
(45) Date of Patent: Dec. 29, 2015

(54) DIRECT PLUG ELEMENT HAVING FORCE-FREE CONTACTING

(71) Applicant: Robert Bosch GmbH, Stuttgart (DE)

(72) Inventor: Markus Kroeckel, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/349,712

(22) PCT Filed: Sep. 21, 2012

(86) PCT No.: PCT/EP2012/068687

§ 371 (c)(1),
(2) Date: Apr. 4, 2014

(87) PCT Pub. No.: WO2013/050264

PCT Pub. Date: Apr. 11, 2013

(65) Prior Publication Data

US 2014/0308858 A1 Oct. 16, 2014

(30) Foreign Application Priority Data

Oct. 4, 2011 (DE) ..... 10 2011 083 949

(51) Int. Cl.

| | |
|---|---|
| ***H01R 13/62*** | (2006.01) |
| ***H01R 13/187*** | (2006.01) |
| ***H01R 12/87*** | (2011.01) |
| ***H01R 13/11*** | (2006.01) |
| *H01R 12/72* | (2011.01) |
| *H01R 13/627* | (2006.01) |
| *H01R 24/62* | (2011.01) |
| *H01R 107/00* | (2006.01) |

(Continued)

(52) U.S. Cl.
CPC ..... *H01R 13/187* (2013.01); *H01R 12/87* (2013.01); *H01R 13/112* (2013.01); *H01R 12/721* (2013.01); *H01R 13/6273* (2013.01); *H01R 24/62* (2013.01); *H01R 2107/00* (2013.01)

(58) Field of Classification Search
CPC ..... H01R 13/187; H01R 13/112; H01R 13/6273; H01R 12/87; H01R 12/721; H01R 24/62
USPC ..... 439/850, 59, 630, 327, 329, 636, 751, 439/326
See application file for complete search history.

(56) References Cited

U.S. PATENT DOCUMENTS 5,057,032 A 10/1991 Kaufman et al.
5,480,316 A * 1/1996 Kinross et al. ..... 439/326

FOREIGN PATENT DOCUMENTS

DE 1089838 9/1960
DE 29623742 11/1999

OTHER PUBLICATIONS

International Search Report for Application No. PCT/EP2012/068687 dated Dec. 20, 2012 (2 pages).

*Primary Examiner* — Javaid Nasri
(74) *Attorney, Agent, or Firm* — Michael Best & Friedrich LLP

(57) ABSTRACT

A direct plug element (2), comprising a plug housing (6), a direct contact (3), which is designed for direct contacting with an exposed contact region (40), wherein the direct contact (3) has a one-piece design, wherein the direct contact (3) is U-shaped and has a contact lamella region (31) and a press-on spring region (32), and wherein a contact point (33) on the contact lamella region (31) is offset in the plugging direction (S) from a press-on point (34) on the press-on spring region (32).

6 Claims, 4 Drawing Sheets

DIRECT PLUG ELEMENT HAVING FORCE-FREE CONTACTING

BACKGROUND OF THE INVENTION

The present invention relates to a direct plug element having a plug housing and a direct contact for direct contacting with exposed contact regions on an opposing piece, for example on a circuit board, and an electrical arrangement having a direct plug element of this type.

Recently, direct plug contacts are being used ever more frequently, wherein a direct plug element is plugged directly onto an opposing piece, for example a circuit board or a stamped lead-frame or substrate. However, the demands in relation to robustness and contact reliability of direct plug elements of this type are increasing especially when using said direct plug elements in the automobile industry. A fundamental problem area in the case of direct contacting resides in the fact that typically the direct plug elements are pushed from the front onto the contact regions on the circuit board, wherein sharp-edged circuit board edges and/or contact regions cause damage to the direct contact during the plugging process. This results from a press-on force that is acting on the contact regions of the circuit board and is built up by way of additional spring elements of the direct contact during the plugging process onto the circuit board. Consequently, surfaces of the direct contacts and the contact surfaces on the circuit board become abraded and chaffed in the case of numerous plugging processes so that damage and/or malfunctions of the electrical arrangement can occur.

SUMMARY OF THE INVENTION

In contrast thereto, the direct plug element in accordance with the invention comprises the advantage that while attaching and/or removing the direct plug element no press-on force that would otherwise act on the contact region arises during the pushing movement of the plugging process. As a consequence, signs of wear and tear on the direct contacts of the direct plug element and contact regions of a circuit board are significantly reduced. Consequently, in accordance with the invention the direct plug element can be easily separated from and reattached to the circuit board a number of times. As a consequence, a further advantage resides in the fact that thinner protective coatings that are typically embodied from gold can be used on the contact surfaces on the contact regions and/or the direct contacts. This produces drastic cost savings. Furthermore, the direct contact itself produces the press-on force on the contact region, so that no additional spring elements are required and consequently the number of necessary components is reduced. This is achieved in accordance with the invention by virtue of the fact that the direct plug element comprises a plug housing and a direct contact that is designed for direct contacting with an exposed contact region. The direct contact is embodied as one part and is U-shaped having a contact lamella region and a press-on spring region. As a consequence, a contact point on the contact lamella region is offset in the plugging direction with respect to a press-on point on the press-on spring region.

In accordance with a preferred embodiment of the invention, the contact point is arranged in the plugging direction in front of the press-on point. As a consequence, the press-on force of the direct contact on the support plate is only generated once the press-on point is reached, so that the contact region of the circuit board can pass the contact lamella region essentially in a normal force free manner during the plugging process. The degree to which the contact point is offset with respect to the press-on point ensures a normal force free overlap between the contact point and the contact region of the circuit board.

It is particularly preferred that the direct contact is mounted on the plug housing in a movable manner. As a consequence, by means of a pivoting movement the direct contact can avoid the circuit board during the plugging process until the press-on spring region is reached. As a consequence, there is essentially no loading on the contact lamella region in front of the contact point of the direct contact, so that the contact point can reach the contact region of the circuit board in a force free manner.

Furthermore, several direct contacts are preferably arranged parallel to one another in the plug housing. As a consequence, a very simple and compact assembly is achieved having a minimal overall length of the direct plug element.

The plug housing preferably comprises at least one guiding region that can be brought into contact with an opposing piece, for example a circuit board, wherein the guiding region is arranged in the plugging direction in front of the contact point. A front face of the guiding region consequently protrudes in a perpendicular manner with respect to the plugging direction at least as far as or farther than the contact point of the contact lamella region. As a consequence, the contact region of the circuit board can be inserted in a tangential manner and consequently in a force free manner as far as the contact point. The guiding region is then inserted into a cut-out that is provided for this purpose and/or an opening in the circuit board and secures the direct plug element, so that a continuous operationally reliable direct contact is ensured. The contact lamella region only comes into contact with the exposed contact region after the guiding region has been inserted.

In accordance with a preferred embodiment of the invention, the guiding regions are arranged at the side on the plug housing. As a consequence, an arrangement that saves space can be achieved in particular in the case of a plurality of direct contacts that are arranged parallel to one another. In addition, only two cut-outs/openings are required in the circuit board for the guiding regions of the plug housing regardless of the number of direct contacts, which essentially further simplifies the opening process.

The invention further relates to an electrical arrangement having a direct plug element in accordance with the invention and an opposing piece having at least one exposed contact region. As a consequence, in each case one of the direct contacts is in contact with one of the contact regions that are arranged at different distances from a support plate edge. The invention is preferably used in the automotive industry, for example in the case of cable harnesses of vehicles.

BRIEF DESCRIPTION OF THE DRAWINGS

Exemplary embodiments of the invention are described in detail hereinunder with reference to the accompanying drawing. In the drawing.

DETAILED DESCRIPTION

Figure 1:
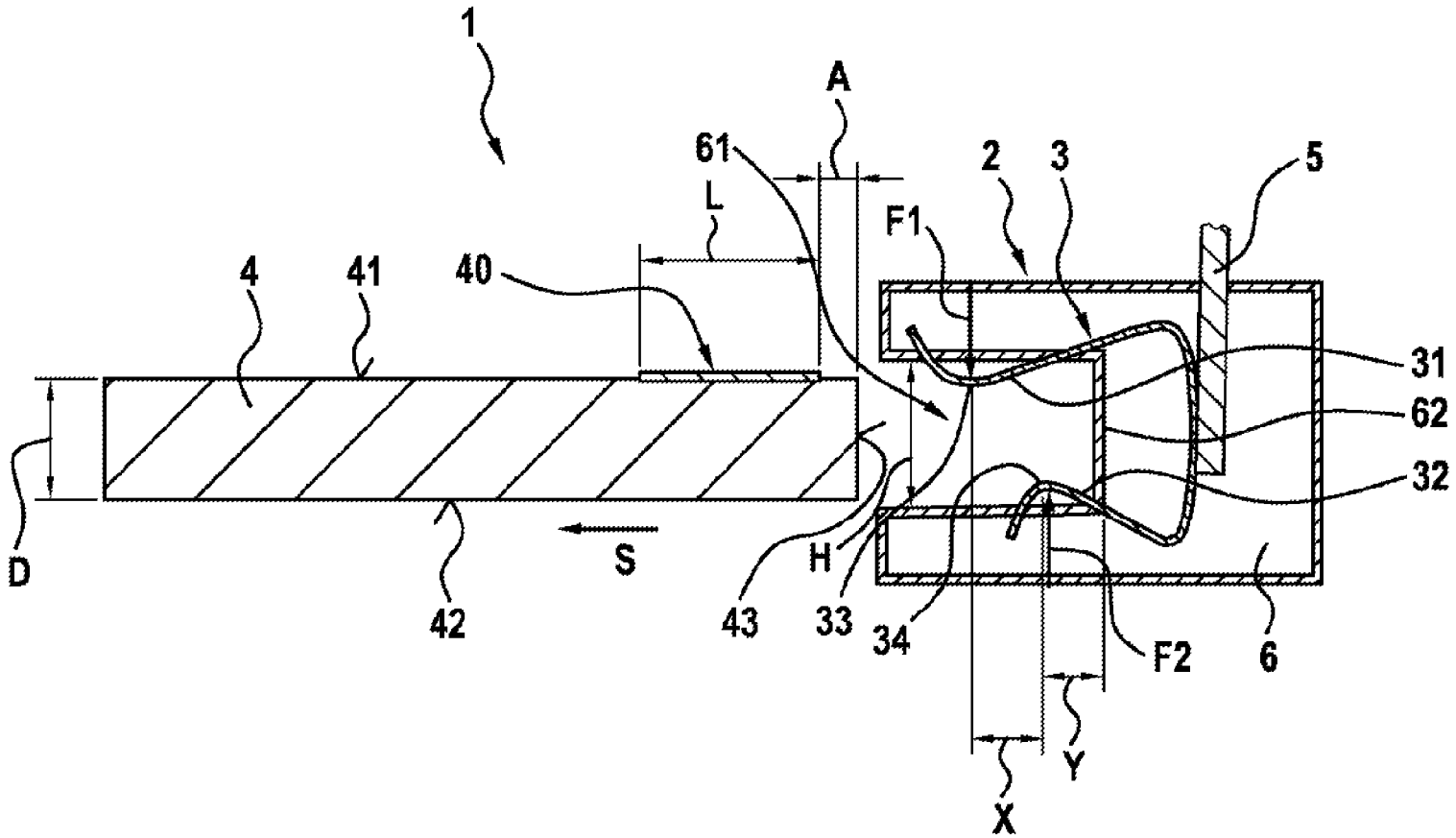
FIG. 1 illustrates a schematic sectional view of an electrical arrangement having a direct plug element in accordance with the invention in accordance with a first exemplary embodiment of the invention.

An electrical arrangement 1 having a direct plug element 2 in accordance with a first preferred exemplary embodiment of the invention is described in detail hereinunder with reference to FIG. 1.

As is evident from FIG. 1, the electrical arrangement 1 comprises a direct plug element 2 and an opposing piece 4, which in this exemplary embodiment is a circuit board that is embodied as one part. The opposing piece 4 further comprises a contact region 40 that is arranged exposed on a first planar face 41. As a result, the contact region 40 comprises a length L relative to a plugging direction S and said contact region is arranged at a distance A from a front face 43 of the opposing piece 4.

The direct plug element 2 comprises a plug housing 6, which is essentially embodied as one part and comprises an opening 61 that is facing the opposing piece 4 that is to be received, and a direct contact 3. The direct contact 3 is fastened in a rigid manner in the plug housing 6 and is connected to a line 5, for example by means of crimping, which line is routed out of the plug housing 6.

As is further evident from FIG. 1, the direct contact 3 is embodied as one part and is U-shaped and comprises a contact lamella region 31 that is facing in a perpendicular manner with respect to the plugging direction S of the first planar face 41 of the opposing piece 4, and a press-on spring region 32 that is arranged opposite said contact lamella region, which press-on spring region is facing a second planar face 42 of the opposing piece 4.

The contact lamella region 31 is embodied in an arcuate manner and protrudes in a perpendicular manner with respect to the plugging direction S into the opening 61 of the plug housing 6 in such a manner that an apex defines a contact point 33 for a contact with the contact region 40. The apex of the press-on spring region 32 that is likewise embodied in an arcuate manner defines a press-on point 34 that is offset by an amount X in the plugging direction S with respect to the contact point 33 and is arranged at a distance Y from a rear end wall 62 of the opening 61.

This arrangement means that as the opposing piece 4 is inserted, the contact region 40 first contacts the contact point 33 on the contact lamella region 31 in a tangential direction. As a consequence, no contact force is produced in a perpendicular manner with respect to the plugging direction S, since a height H of the opening is greater than a thickness D of the opposing piece 4. A spring force that is illustrated respectively by arrows F1 and F2 is generated in a perpendicular manner with respect to the plugging direction S on the press-on point 34 and on the contact point 33 only when the front face 43 of the opposing piece 4 reaches the press-on spring region 32. As a consequence, the offset amount X and the distance Y of the direct contact 3 are preferably dimensioned in such a manner that their sum corresponds to the distance A and the half-length L of the contact region 40 on the opposing piece 4 ($X+Y=A+L/2$). As a consequence, in the plugged state, the contact lamella region 31 lies approximately in the middle of the exposed contact region 40.

In the case of the described arrangement in accordance with the invention, it is consequently possible to produce an essentially normal force free contact of the direct contact 2 with the contact region 40, which arrangement prevents sharp edges on the opposing piece 4 and/or on the contact region 40 from damaging the contact lamella region 31 during the plugging process. Furthermore, no additional spring elements are required since the contact force is generated by way of the direct contact 3 itself.

Hereinunder, an electrical arrangement having a direct plug element 2 in accordance with a second preferred exemplary embodiment of the invention is described in detail with reference to the FIG. 2. Similar or functionally similar components are described with the same reference numerals as in the first exemplary embodiment.

Figure 2A:
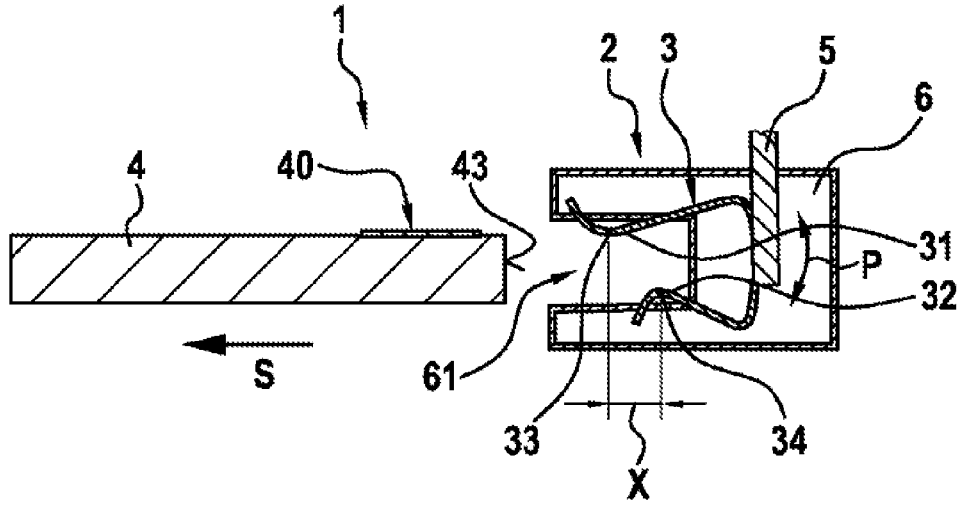
FIGS. 2A, 2B, 2C illustrate schematic sectional views of an electrical arrangement having a direct plug element in accordance with the invention in accordance with a second exemplary embodiment of the invention, which clarifies the plugging process.

In contrast to the previously described first exemplary embodiment, the direct contact 3 in the direct plug element 2 of the second exemplary embodiment is mounted in a movable manner on the plug housing 6, as illustrated in FIG. 2A by way of a double arrow P.

Figure 2B:
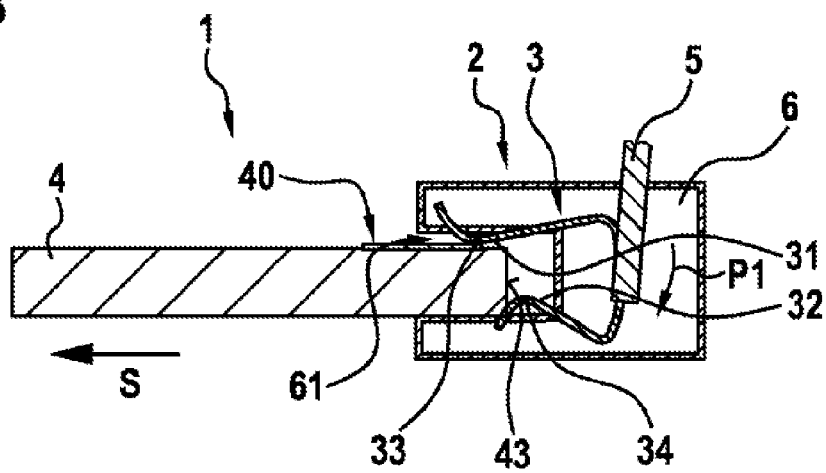

As a consequence, the direct contact 3 can, as is illustrated in FIG. 2B, implement a pivoting movement in the direction of an arrow P1 if the contact region 40 contacts the contact lamella region 31 during the plugging process in the opening 61 of the plug housing 6. This pivoting movement causes the direct contact 3 to avoid the opposing piece 4, so that no normal force acts between the contact point 33 and the contact region 40 before the front face 43 of the opposing piece 4 has reached the press-on spring region 32.

Figure 2C:
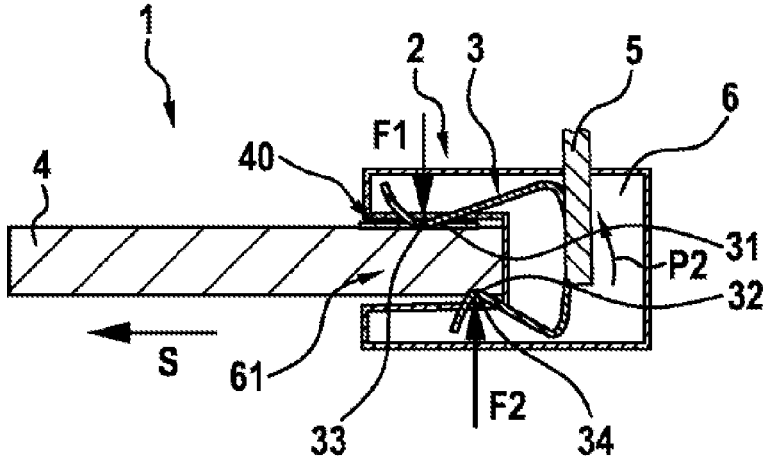

As is illustrated in FIG. 2C, during the complete plugging process and/or insertion of the opposing piece 4, the press on spring region 32 is pushed against the force F2 in a perpendicular manner with respect to the plugging direction S against the plug housing 6. This results in a pivoting movement of the direct contact 3 in the direction of an arrow P2 and the opposing force F1 is generated on the contact point 33 of the contact lamella region 31 for the purpose of direct contacting with the contact region 40.

In the case of the described embodiment, it is consequently possible in a more effective manner by way of the pivoting and/or avoiding movement of the direct contact 3 to prevent damage occurring to the contact lamella region 31. In addition, as a consequence small angular deviations in relation to the plugging direction S can be compensated for during the insertion of the opposing piece 4.

An electrical arrangement having a direct plug element 2 in accordance with a third preferred exemplary embodiment of the invention is described in detail hereinunder with reference to FIGS. 3A to 3C and 4. Similar or functionally similar components are described with the same reference numerals as in the first exemplary embodiment.

Figure 3A:
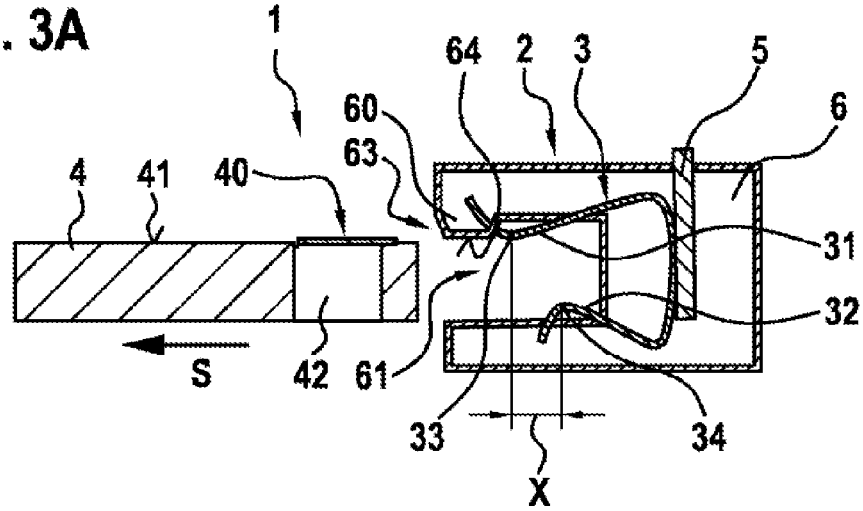
FIGS. 3A, 3B, 3C illustrate schematic sectional views of an electrical arrangement having a direct plug element in accordance with the invention in accordance with a third exemplary embodiment of the invention, which clarifies the plugging process.
Figure 3B:
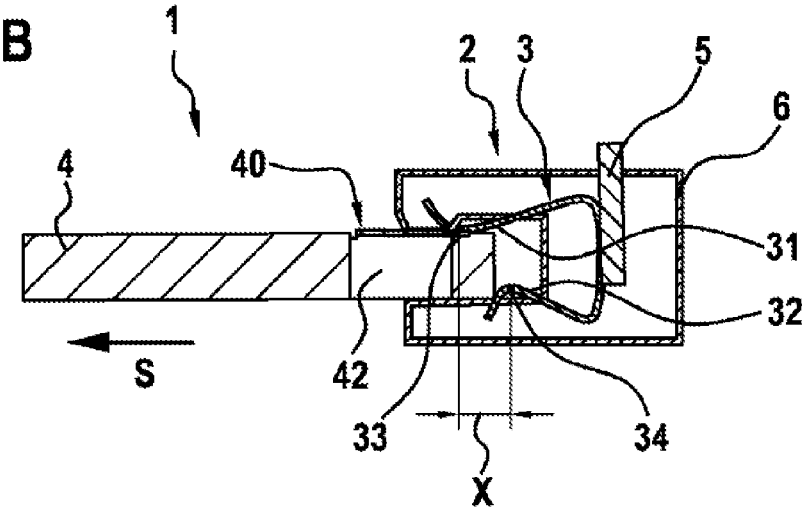

In contrast to the previously described first exemplary embodiment, the opposing piece 4 comprises, as is illustrated in FIG. 3A, a cut-out 42 that is arranged in the plugging direction S at the height of the contact region 40. In addition, a guiding region 60 is provided in the plug housing 6 of the direct plug element 2, which guiding region is arranged on the front face 63 of the opening 61, which front face faces the first planar face 41 of the opposing piece 4. An end section 64 of the guiding region 60 protrudes preferably at least as far as preferably farther than the contact point 33 of the contact lamella region 31 into the opening 61. As a consequence, the contact region 40 of the opposing piece 4, as is evident in FIG. 3B, can pass the contact lamella region 31 during the plugging process in the region of the offset X in a tangential manner and in a normal force free manner without a press-on force that is generated by way of the press-on spring region 32 acting on the contact lamella region 31.

Figure 3C:
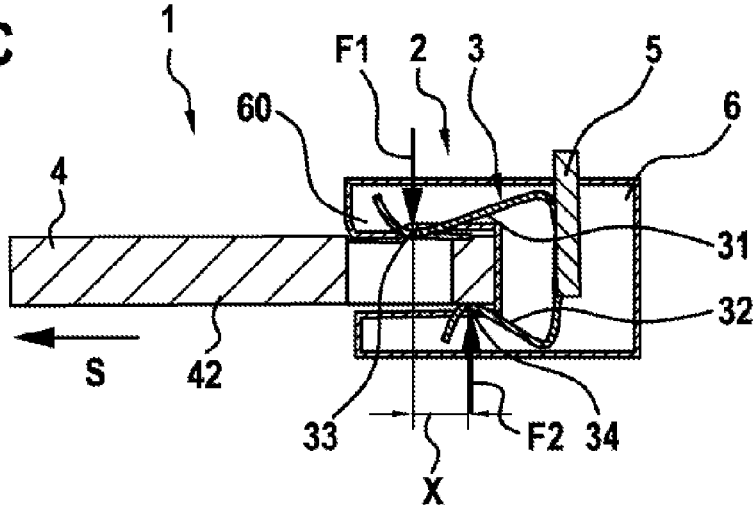

When the opposing piece 4 is fully plugged in, as is evident in FIG. 3C, the guiding region 60 is pushed into the cut-out 42 as a result of the pressure that is generated by way of the forces F1, F2 on the contact lamella region 31 and the press-on spring region 32 of the direct contact 3 and the plug housing 6 engages with the opposing piece 4.

Figure 4:
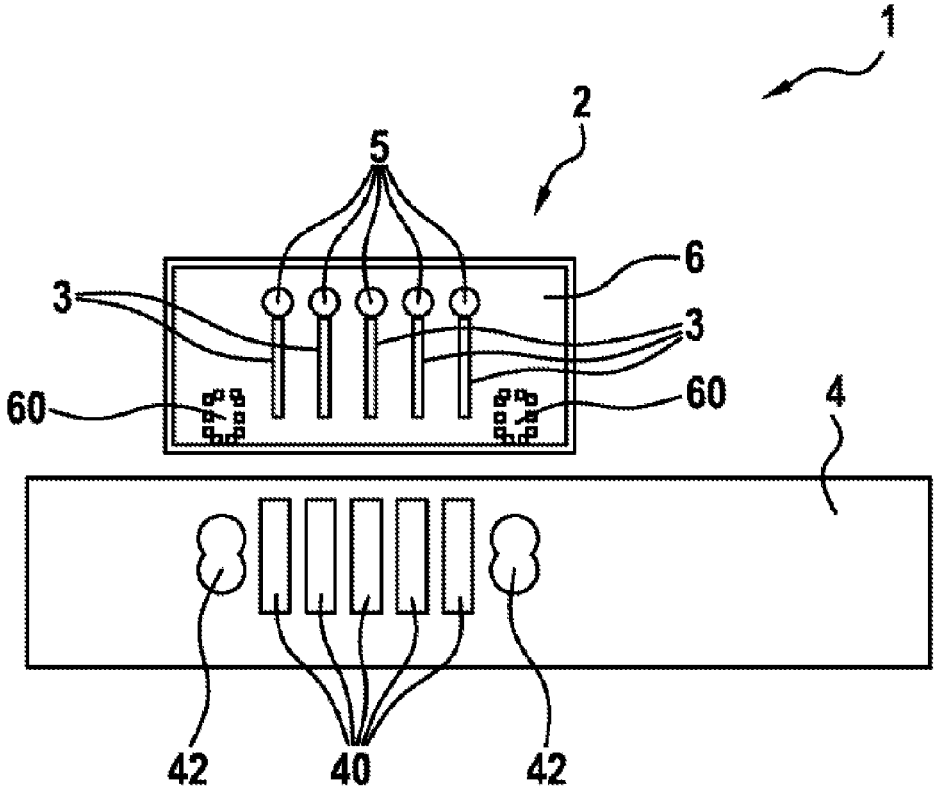
FIG. 4 illustrates a schematic plan view of the electrical arrangement in FIG. 3.

As is illustrated in the plan view in FIG. 4, a cut-out 42 is arranged on the opposing piece 4 in each case on both sides of contact regions 40 that are arranged parallel to one another. The cut-outs 42 can be embodied both as through-going holes or alternatively as depressions in the opposing piece 4.

It is consequently possible in the case of the described exemplary embodiment to fix the plug housing 6 on the opposing piece 4 additionally in a form-fitting manner, which results in a continuous operationally reliable direct contacting for all operating conditions and all types of application of the direct plug element 2.

What is claimed is:

1. An electrical arrangement comprising:

an opposing piece (4) having at least one exposed contact region (40) and a cut-out (42); and a direct plug element (2) including a plug housing (6) having at least one guiding region (60) configured to be brought into contact with the opposing piece (4), a direct contact (3) that is configured to directly contact the at least one exposed contact region (40), wherein the direct contact (3) is embodied in a U-shaped manner having a contact lamella region (31) and a press-on spring region (32), the contact lamella region (31) includes a contact point (33) that is offset in a plugging direction (S) with respect to a press-on point (34) on the press-on spring region (32), and wherein the direct contact (3) is formed as one piece, wherein the at least one guiding region (60) is arranged in the plugging direction (S) in front of the contact point (33), wherein the at least one guiding region (60) includes an end section (64), the end section (64) extending equidistant to or protruding farther than the contact point (33), in a direction perpendicular to the plugging direction (S), and wherein the cut-out (42) receives the at least one guiding region (60) of the plug housing (6) of the direct plug element (2) as a result of forces exerted on the opposing piece (4) by the press-on spring region (32).

2. The arrangement as claimed in claim 1, characterized in that the contact point (33) is arranged in the plugging direction (S) in front of the press-on point (34).

3. The arrangement as claimed in claim 1, characterized in that the direct contact (3) is mounted in a movable manner on the plug housing (6).

4. The arrangement as claimed in claim 1, characterized in that a plurality of direct contacts (3) are arranged parallel to one another in the plug housing (6).

5. The arrangement as claimed in claim 1, characterized in that the guiding region (60) is arranged at a side on the plug housing (6).

6. The arrangement as claimed in claim 1, characterized in that the opposing piece (4) is a circuit board.

* * * * *